United States Patent [19]

Zelmin

[11] Patent Number: 4,948,065

[45] Date of Patent: Aug. 14, 1990

[54] CABLE REEL

[75] Inventor: Arnold E. Zelmin, Vällingby, Sweden

[73] Assignee: Aktiebolaget Electrolux, Stockholm, Sweden

[21] Appl. No.: 271,633

[22] Filed: Nov. 16, 1988

[30] Foreign Application Priority Data

Dec. 1, 1987 [SE] Sweden ..... 8704803

[51] Int. Cl.[5] ..... B65H 75/48

[52] U.S. Cl. ..... 242/107.6; 242/107.7

[58] Field of Search ..... 242/107.3, 107.6, 107.7, 242/107.12

[56] References Cited

U.S. PATENT DOCUMENTS

| | | | |
|---|---|---|---|
| 2,393,138 | 1/1946 | Borkoski | 242/107.6 |
| 2,393,417 | 1/1946 | Ruttkay | 242/107.6 |
| 2,584,559 | 2/1952 | Dalrymple | 242/107.3 X |
| 3,578,259 | 5/1971 | Zelnick | 242/107.6 X |
| 4,270,708 | 6/1981 | Vonk | 242/107.3 |

*Primary Examiner*—John M. Jillons

*Attorney, Agent, or Firm*—Pearne, Gordon, McCoy & Granger

[57] ABSTRACT

A spring powered cable reel, particularly for a vacuum cleaner, comprises a rotatable drum (10) from which the cable (3) is wound off during tightening of the spring (12). The drum is prevented from rotation in the winding-up direction by a brake which is releasable to allow the cable to be wound up. The brake is adapted to be locked in the released position by means of a catch assembly (17,21,24) which is actuatable by the torque of the spring (12) to apply the brake when the torque exceeds a predetermined value.

3 Claims, 2 Drawing Sheets

CABLE REEL

BACKGROUND OF THE INVENTION

The present invention relates to a cable reel comprising a rotatable drum from which the cable is wound off against the action of a spring which is tightened during winding off, and a brake adapted to prevent the drum from rotating in the winding-up direction and releasable to release the drum in order to wind up the cable by means of the spring.

Cable reels of this kind are used extensively, particularly in vacuum cleaners. The energy required for rotation of the drum during winding of the cable is provided by the spring, and the brake mechanism locks the drum automatically when the desired cable length has been wound off. For this purpose the brake mechanism generally comprises some type of catch arrangement which allows the drum to rotate in one direction only, i.e. the winding-off direction. When the cable is to be wound up, the catch must be made inoperative which is performed by means of a puch button or a pedal. In the cable reels used hitherto the push button or the pedal must be kept pushed down during the whole time the cable is wound onto the drum, since the brake is otherwise applied immediately so that the rotation is interrupted.

SUMMARY OF THE INVENTION

The object of the present invention is to provide a cable reel in which the brake can be latched in its inoperative position in order to allow the drum to rotate freely without the need to keep a button or the like pushed down, until the entire cable has been wound up or the winding has been obstructed in some other manner. This has been obtained by means of a cable reel of the kind mentioned in the introduction which according to the invention is characterized by a catch assembly adapted to catch the brake in its released position and actuatable by the torque of the spring to apply the brake when said torque exceeds a predetermined value.

BRIEF DESCRIPTION OF THE DRAWINGS

The invention will be described in more detail below with reference to the accompanying drawings, in which.

DETAILED DESCRIPTION OF THE PREFERRED EMBODIMENT

Figure 1:
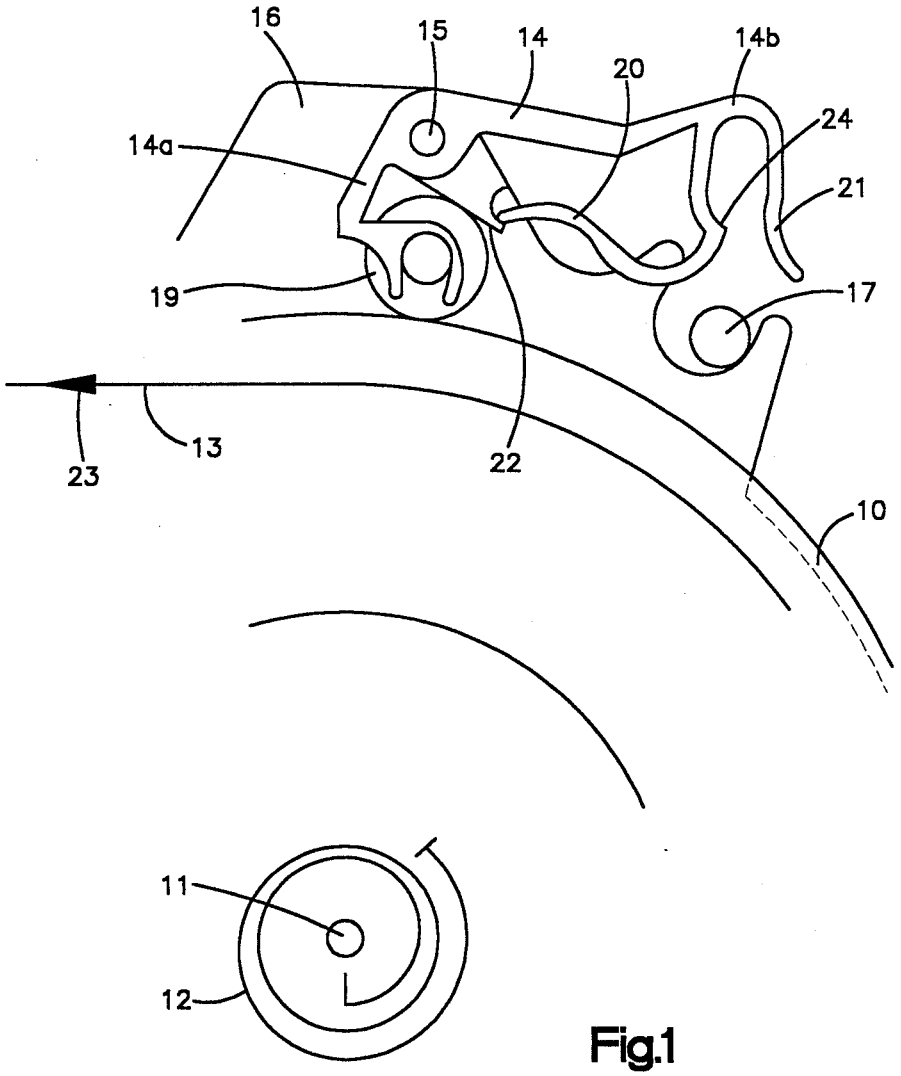
FIGS. 1 and 2 illustrate diagrammatical side elevations of the cable reel according to the invention in two different positions.

The cable reel illustrated in the drawings comprises a drum 10 which is rotatable around a shaft 11 by means of a spring 12. The drum and the spring are shown only partially. A diagrammatically indicated cable 13 is wound on the drum 10. The drum is braked in the winding-up direction by a brake assembly comprising a double lever 14 which is rotatably journalled on a shaft 15 attached to a bracket 16 which in turn is journalled for limited rotation around shaft 11. The rotational movement of the bracket is restricted by a stationary bar 17 provided in a recess 18 in the bracket. The lever 14 has a first leg **14*a* provided with a roller 19, and a second leg 14*b* provided with two springs 20 and 21**, respectively.

The outer end of the spring 12 is attached to the drum 10, and the inner end thereof is connected to the bracket 16. Consequently, the torque produced by the spring strives to rotate the bracket counter-clockwise to the position shown in FIG. 1.

In the position shown in FIG. 1, the roller 19, which is preferably made of rubber, engages both the drum 10 and an oblique contact surface 22 of the bracket 16. The lever 14 is held in this position by the spring 20 whereby the drum is prevented from rotation in the winding-up direction but can be rotated in the opposite direction to wind off the cable, as indicated by the arrow 23.

Figure 2:
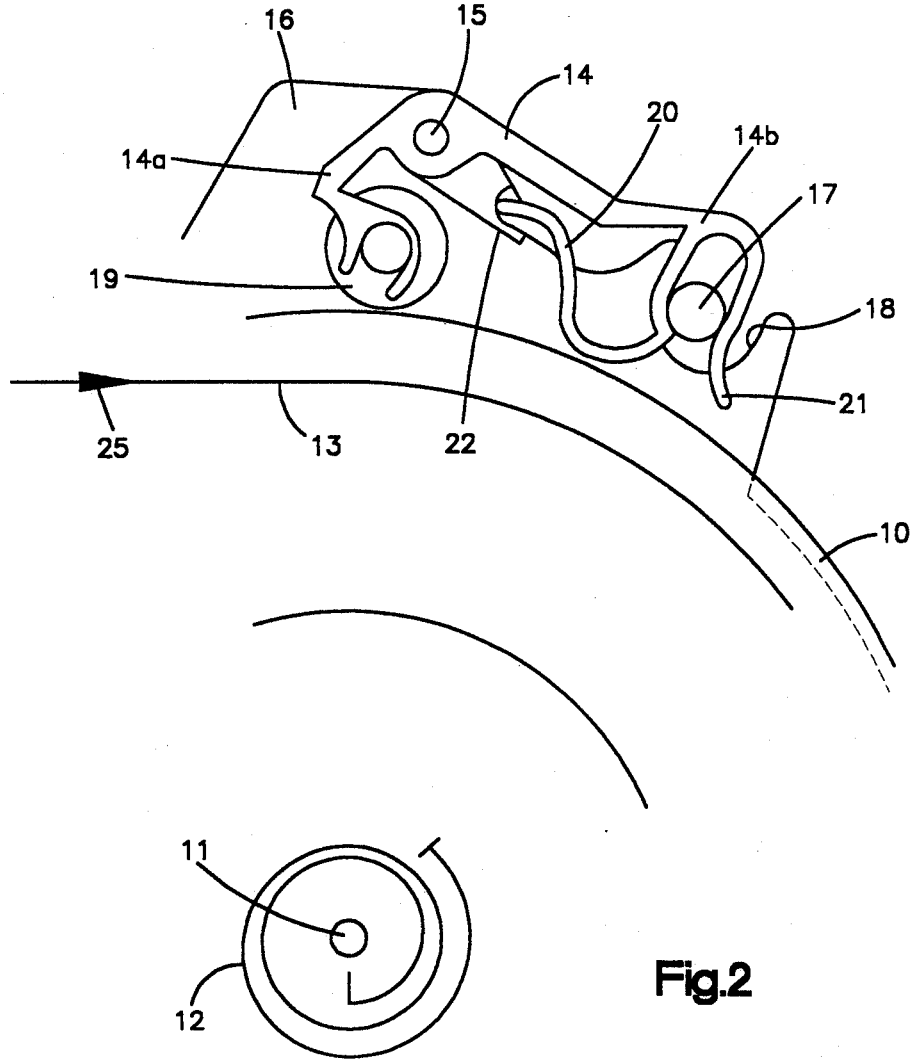

When the cable is to be wound up, the leg **14*b* of lever 14 is pushed down to the position shown in FIG. 2 in which the lever is latched in that the bar 17 engages a step 24. The lever 14 is held in this position by the spring 21 which is thus able to overcome the force of spring 20. The roller 19 is then clear from the drum 10 and the contact surface 22, and the drum is consequently rotated by the spring 12 to wind up the cable 13, as indicated by arrow 25. When the rotation of the drum is stopped by the cable, either because the whole cable has been wound up or the winding is obstructed, the reaction torque of the spring 12 acting on the bracket 16 increases, whereby the bracket is rotated counter-clockwise against the action of the spring 21. The bar 17 is then released from its engagement with the step 24 and the lever 14 returns to the position of FIG. 1 due to the action of spring 20**, whereby the brake is applied.

In order to obtain the described function the springs 12, 20 and 21 are mutually adapted such that the brake is applied when the rotation of the drum is obstructed to such extent that the torque of spring 12 exceeds a predetermined value.

The described device can also be used in a conventional way in which the leg **14*b*** is depressed only slightly so that the brake is released without catching the lever in the released position.

I claim:

1. In a cable reel comprising a rotatable drum (10) from which a cable is wound on and off a spring (12) for biasing the reel to wind up the cable, said spring being tightened during winding off of the cable, and a brake for preventing drum rotation in the winding-up direction and operable to release the drum in order to wind up the cable by means of the spring, the improvement wherein a catch assembly (17,21,24) is provided to catch the brake in its released position and means actuatable by the torque of the spring (12) to apply the brake when said torque exceeds a predetermined value, the spring (12) being connected between the rotatable drum (10) and means for mounting the brake.

2. A cable reel according to claim 1, wherein said mounting means is a bracket (16) rotatable around the axis (11) of the drum (10) due to actuation by the spring (12) in order to release the catch assembly.

3. A cable reel according to claim 1 or 2, wherein the brake comprises a lever (14) which is rotatable between applied and released positions, said catch assembly comprising a step (24) provided on said lever for engaging a stationary catch means (17) in the released position, and a second spring (21) adapted to maintain the lever (14) in this position.

* * * * *